United States Patent [19]

Kramm

[11] 4,291,506

[45] Sep. 29, 1981

[54] HONE STONE WITH COMPRESSIBLE ENDS

[75] Inventor: Carl H. Kramm, Pinckney, Mich.

[73] Assignee: RLK Research, Inc., Howell, Mich.

[21] Appl. No.: 8,420

[22] Filed: Feb. 1, 1979

[51] Int. Cl.[3] ..... B24B 33/02

[52] U.S. Cl. ..... 51/338; 51/204; 403/354

[58] Field of Search ..... 51/330, 331, 338–351, 51/204; 403/297, 354, 371

[56] References Cited

U.S. PATENT DOCUMENTS

| | | | |
|---|---|---|---|
| 1,263,020 | 4/1918 | Becker | 403/371 X |
| 2,790,277 | 4/1957 | Calvert | 51/346 X |
| 2,952,952 | 9/1960 | Stanhope | 51/204 |
| 2,991,597 | 7/1961 | Calvert | 51/346 X |
| 3,037,333 | 6/1962 | Stelmachowski | 51/346 |
| 3,123,945 | 3/1964 | Engle . | |
| 3,154,893 | 11/1964 | Greenberg et al. | 51/338 X |
| 3,399,322 | 8/1968 | Ambe | 403/354 X |
| 3,403,481 | 10/1968 | McDonald | 51/338 X |
| 3,641,715 | 2/1972 | Kramm . | |
| 3,711,260 | 1/1973 | Kramm et al. | 51/338 X |
| 3,871,140 | 3/1975 | Kramm . | |
| 4,090,798 | 5/1978 | Barton | 403/297 X |
| 4,179,855 | 12/1979 | Gillette | 51/346 X |

*Primary Examiner*—Gary L. Smith
*Assistant Examiner*—Robert P. Olszewski
*Attorney, Agent, or Firm*—Beaman & Beaman

[57] ABSTRACT

The invention pertains to hone stone apparatus utilizing radially movable stone assemblies located in a rotating or oscillating head and radially movable through openings defined in the head for engagement with the workpiece. The stone assemblies include an abrasive stone partially embedded within a synthetic plastic body and the end regions of the body are slightly oversized with respect to the head opening configuration and the body end regions are slotted to permit compression wherein a firm frictional engagement exists between the stone assembly and the head for retaining the stone assembly within its head opening.

2 Claims, 7 Drawing Figures

HONE STONE WITH COMPRESSIBLE ENDS

SUMMARY OF THE INVENTION

The invention pertains to hone stone assemblies frictionally retained within a hone head, and a head configuration complimentary to the stone assembly utilizing the inventive concepts thereof.

Honing apparatus is widely used for finely finishing cylinders and bores, and honing tools utilized to finish bores between three-quarter inch and four inch diameter often utilize a cylindrical head of a diameter slightly smaller than the bore to be finished wherein the head includes a plurality of radial openings in which stone assemblies are radially movable by means of a wedge axially displaceable within the head engaging the inner surface of the stone assemblies to control the radial positions thereof.

As the hone stone is consumed by use the stone assembly is outwardly radially displaced by the head wedge, and upon the stone assemblies being substantially consumed it is removed from the head, the wedge retracted, and new stone assemblies are inserted into the head openings.

One of the problems attendant with the aforedescribed hone assembly lies in the retention of the stone assembly within the head openings. Most hone stone devices utilize a frictional engagement between the stone assembly and head opening, and such frictional engagement must be sufficient to retain the stone assembly within the head when the head is withdrawn from the bore being machined even though significant vibration and heat may be present.

Hone stone assemblies commonly consist of an abrasive stone mounted with a body, the body being formed of metal or synthetic plastic. Friction retaining means are formed on the body for engagement with the head opening, and a variety of such retaining means are available. For instance, in the assignee's U.S. Pat. Nos. 3,641,715 and 3,711,260 retaining means are disclosed for use with a metallic body stone assembly. In U.S. Pat. Nos. 2,790,277; 2,952,952, 2,991,597; 3,037,333; 3,123,945; 3,154,893; 3,403,381 and in the assignee's Pat. No. 3,871,140, hone stone assemblies are disclosed utilizing synthetic plastic bodies and a variety of means and configurations for increasing the frictional engagement between the stone assemblies and the head opening.

The applicant has found that friction increasing devices formed on the lateral sides of the hone assembly often fail because of the circumferential forces imposed upon the assembly during use, and by concentrating the friction means in the stone assembly end regions superior results have been achieved. However, as hone stone assemblies are consumed in large numbers in a variety of manufacturing operations it is most important that the cost thereof be minimized and yet the dependability of operation and the efficiency of the regaining means be of the highest level. Previous hone stone assembly innovations have not met all of the prerequisites of such apparatus and it is an object of the invention to improve the state of the art in friction retained hone stone assemblies utilizing synthetic plastic bodies.

It is an object of the invention to provide an improved hone stone head and hone stone assembly wherein the stone assembly utilizes a synthetic plastic body and improved friction producing means are defined on the body which are of an economical construction and do not require complicated machining or fabrication techniques.

In the practice of the invention the cylindrical honing head is provided with radial openings for closely receiving the hone stone assembly, and in the preferred embodiment the head openings are of an elongated configuration having linear lateral sides and concave cylindrical segment ends tangentially related to the sides. The hone stone assembly includes an abrasive stone element partially embedded within an elongated synthetic plastic body wherein the outer surface, and a leading edge, of the stone are exposed for engagement with the workpiece. The synthetic plastic body extends along one of the stone lateral sides, is located radially inward of the stone and body end regions extend beyond the ends of the stone.

The synthetic plastic end regions of the body are of a configuration complimentary to the head opening ends, and preferably include lateral sides substantially tangentially intersecting cylindrical segment surfaces. The dimension of the stone assembly end regions is slightly greater than the corresponding portion of the head opening and the end regions are provided with slots transversely disposed to such "oversized" assembly end region dimension permitting deformation of the end region in the direction of the oversized dimension. Such end region deformation being possible due to the resilient nature of the synthetic plastic body material. Thus, the slot permits the stone assembly to be inserted within the head opening, and the "spring back" of the deflected assembly end regions maintains a firm frictional contact with the hone head throughout the lift of the stone assembly.

Preferably, the slot is defined in the stone assembly body in a direction parallel to the body length, but the inventive concepts may also be practiced by slotting the body end region in a direction transverse to the body length.

BRIEF DESCRIPTION OF THE DRAWINGS

The aforementioned objects and advantages of the invention will be apparent from the following description and accompanying drawings wherein.

DESCRIPTION OF THE PREFERRED EMBODIMENT

Figure 1:
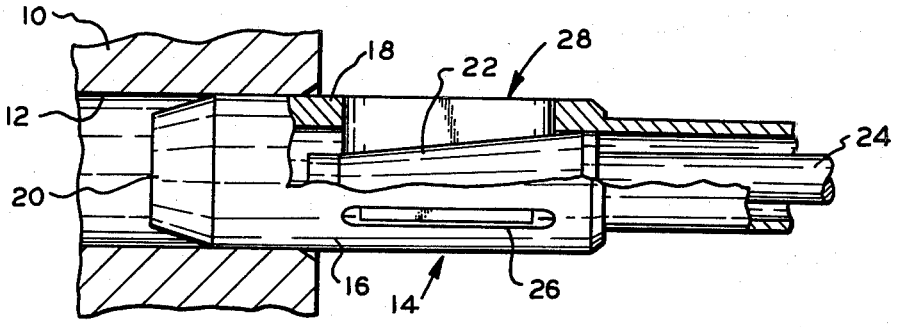
FIG. 1 is an elevational view, partially sectioned, of a hone head and stone body assembly in accord with the invention illustrating the hone head partially entering a bore to be machined.

FIG. 1 illustrates the relationship of components associated with the invention wherein a workpiece 10 having a bore 12 to be honed is illustrated as partially receiving the hone head assembly generally indicated at 14.

The hone head assembly includes a cylindrical head 16 having a cylindrical exterior surface 18 and a conical pilot portion 20. The head is hollow and includes a wedge member 22, which may be of a conical configuration, axially displaceable therein by an actuator rod 24 connected to hone machine structure, not shown, for selectively axially displacing the wedge relative to the head 16.

The head 16 is provided with a plurality of circumferentially spaced openings 26 each of which receives a hone stone assembly 28. The hone stone assemblies are engaged at their innermost end by the wedge 22 and are forced radially outward from their associated opening 26 by the wedge as the wedge is translated to the left, FIG. 1.

Figure 2:
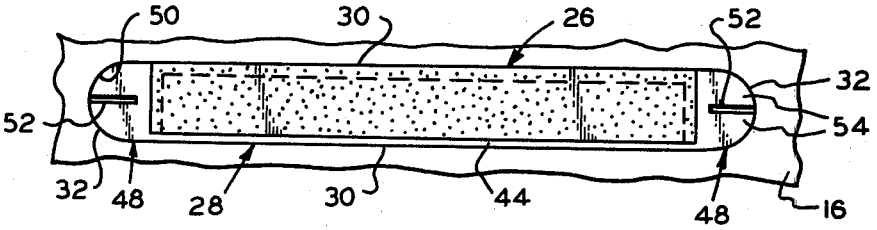
FIG. 2 is a plan, enlarged, detail view of a hone head opening with a stone assembly received therein.

FIG. 2 illustrated the configuration of the head openings 26, such openings including spaced parallel linear sides 30 and end surfaces 32 consisting of concave cylindrical segments tangentially related to the associated opening sides 30.

The hone stone assembly 28 includes a synthetic plastic body 34 in which the abrasive stone element 36 is embedded. The synthetic plastic material of the body is soft enough to prevent scratching or marring the workpiece bore 12, it is relatively hard, but has a resilient nature and memory with respect to deformation. One type of material that may be used is styreneacrylonitrile copolymer reinforced by a glass fiber content 20 percent by weight made by Thermofil, Inc., Ypsilanti, Michigan, Product B-2000FG. The stone 36 is formed of conventional abrasive bonded particles, and a variety of particles are utilized in accord with the customers order. The stone is of a rectangular elongated configuration having an outer surface 38, FIG. 7, and a forward lateral surface 40, which are exposed, and the stone is preferably reinforced by a steel plate 42 located below the stone and extending substantially the length and width thereof.

Figure 6:
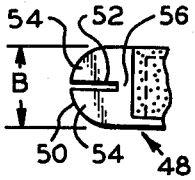
FIG. 6 is a detail, top view of the stone assembly as taken along Section VI—VI of FIG. 4.
Figure 7:
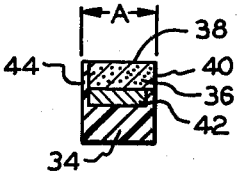
FIG. 7 is an elevational sectional view taken along Section VII—VII of FIG. 4.

The body 34 includes a thin side portion 44, FIG. 7, extending adjacent the trailing lateral edge of the stone and the portion 44 serves to protect the head opening side 30 and prevent the stone from wearing the same. The body 36 also includes an inner obliquely disposed surface 46 which is engaged by the wedge 22, and substantial plastic material is located at the body end regions 48. The end regions 48 are each provided with a convex cylindrical surface 50 of a diameter slightly greater than the width of the stone assembly 28 at its central region such as at Section VII—VII as represented by dimension A, FIG. 7. For instance, the diameter of the end regions 48 i.e., the distance B as represented in FIG. 6, is preferably several thousandths of an inch greater than the dimension A. In one commercial form of the invention the dimension A is 0.250 inches while the diametrical dimension B is 0.254 inches. It is to be understood that the aforementioned dimensions of the stone body are those dimensions of the body assembly prior to being received within a head opening 26.

Figure 4:
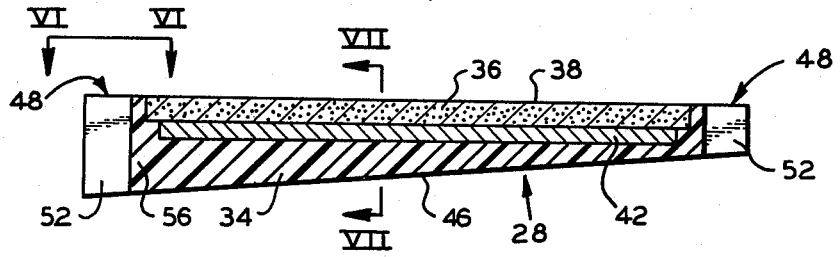
FIG. 4 is an elevational sectional view of a hone stone assembly, per se, in accord with the invention.
Figure 5:
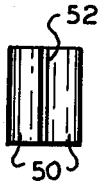
FIG. 5 is an end elevational view of the stone assembly of FIG. 4 as taken from the left thereof.

The end regions 48 are each provided with a slot 52 which extends through the radial dimension of the associated end region, as will be appreciated from FIG. 4. The slots 52 divide the end regions into bifurcated portions 54 capable of hinging or deflecting about a hinge portion 56, and the slots are of sufficient width to permit deflection of the portions 54 toward each other a distance capable of permitting the end regions to be inserted into the head openings 26 which are of uniform width between sides 30 and ends 32 and tangential to sides 30. For instance, openings 26 may be 0.250 inches wide and ends 32 0.250 inches in diameter.

Figure 3:
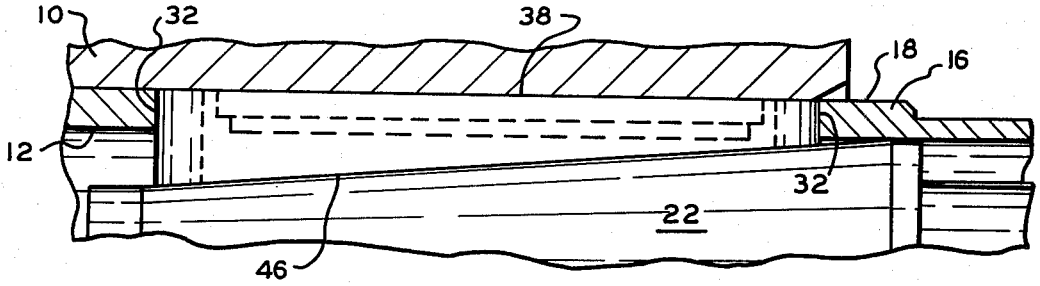
FIG. 3 is an enlarged, elevational, sectional view of a hone head utilizing the stone assembly of the invention as received within a workpiece bore.

Thus, it will be appreciated that by deflecting the end portions 54 at each end region of the hone stone assembly the assembly 28 may be inserted into a head opening 26 in the manner apparent in FIGS. 1 and 3, and the resiliency of the material of the body 34 will maintain the arcuate cylindrical segment surfaces 50 of the portions 54 in a tight frictional engagement with the opening at surfaces 32 in view of the original oversize dimensioning of the body surfaces 50. The frictional engagement of the body surfaces 50 with the opening ends 32 continues throughout the operative life of the stone assembly and a positive frictional engagement of the hone stone assembly and head opening exists regardless of the radial dimension of the stone assembly. The forming of the slots 52 may be accomplished either in the molding process forming the body 34 or the slots may be cut into the body after molding.

In the illustrated embodiment the slots 52 lie in a coincident plane bisecting the longitudinal length of the hone stone assembly. It is to be appreciated that the slots 52 could be offset one side or the other of this bisecting plane, and it is also within the scope of the invention to provide the end regions 48 with slots transversely disposed to the body longitudinal length, and such slots could be perpendicular to the body length. In an embodiment wherein the end region slots were perpendicular, or substantially perpendicular, to the hone assembly length the overall uncompressed or undeformed length of the assembly 28 would be several thousandths of an inch greater than the length of the head opening 26, rather than the dimensional difference existing between the circumferential width of the head opening and end regions as described above. In either embodiment the presence of the slot permits closing of the slot width upon deformation of the hone stone assembly end region to provide the desired frictional retention force of the stone assembly.

It will be appreciated that other modifications to the inventive concept may be apparent to those skilled in the art without departing from the spirit and scope thereof.

I claim:

1. A hone stone assembly for use with honing heads having stone receiving openings defined by side surfaces and end surfaces and an internal stone assembly support and expander comprising, in combination, a synthetic plastic relatively rigid body having a longitudinal axis, a bottom surface, first and second lateral sides, a top surface and first and second end regions having convex cylindrical segment end surfaces, a cavity defined in said body intersecting said top surface, an abrasive stone mounted within said cavity having a working face disposed adjacent said top surface, and a slot defined in each of said end regions extending in the direction of said body axis intersecting said top and bottom surfaces and the associated end surfaces defining a pair of stiffly resilient cantilevered bifurcated portions in each end region extending in the direction of said body axis whereby said slot permits said bifurcated portions of said end region on opposite sides of said slot to deflect toward each other upon insertion of said body in a honing head opening having a lateral dimension adjacent the opening end surfaces slightly less than the width of the slotted end region to provide a firm frictional engagement between the hone stone assembly and the honing head.

2. In a hone stone and head assembly including an elongated hollow honing head having a radial opening defined by spaced longitudinal sides and arcuate concave end surfaces interconnecting the opening sides, an elongated hone stone assembly received within the opening including a synthetic plastic body supporting an abrasive stone, the stone assembly engaging the sides of the head opening and the assembly including synthetic plastic arcuate convex end regions having side surfaces, said end regions engaging the head opening end surfaces and sides adjacent the end surfaces, the sides of the head opening adjacent said end surfaces being separated by a lesser dimension than the normal spacing between the side surfaces of said assembly end regions, the improvement comprising, said hone stone assembly end regions each constituting a mass of synthetic plastic material adapted to be confined within the head opening adjacent the opening end surfaces, and said end regions having inner, outer and end surfaces with a radial slot defined in at least one of said end region masses equidistant between said end region side surfaces and substantially parallel to the length of said stone assembly intersecting said end region inner, outer and end surfaces defining equal bifurcated end region portions of sufficient length in the direction of the length of the hone stone assembly to permit said end region bifurcated portions to be deformed by the head opening upon being received therein, the frictional engagement of said bifurcated portions with the head opening sides maintaining the stone assembly within the head opening.

* * * * *